US005503474A

United States Patent [19]

Krzywdziak

[11] Patent Number: 5,503,474

[45] Date of Patent: Apr. 2, 1996

[54] DEVICE FOR CLOSING SHAKER LIDS OF TINS OF PAINT ON SHAKER MACHINES

[75] Inventor: Alain Krzywdziak, Orleans, France

[73] Assignee: F.A.S., Orleans Cedex 2, France

[21] Appl. No.: 327,637

[22] Filed: Oct. 24, 1994

[30] Foreign Application Priority Data

Oct. 25, 1993 [FR] France ..... 93 12686

[51] Int. Cl.[6] ..... B01F 15/00

[52] U.S. Cl. ..... 366/347; 366/605; 277/143; 70/163

[58] Field of Search ..... 366/347, 605, 366/244, 245, 247, 249, 250, 251, 208, 209, 211, 219; 220/324; 292/DIG. 56, DIG. 73, 256.63, 256.65; 70/163, 166; 248/147, 154

[56] References Cited

U.S. PATENT DOCUMENTS

| | | | |
|---|---|---|---|
| 2,037,240 | 4/1936 | Johnson | 292/256.65 |
| 2,585,334 | 2/1952 | McCauley | 220/55 |
| 3,021,118 | 2/1962 | Dedoes | 366/247 |
| 3,041,052 | 6/1962 | Dedoes | 366/247 |
| 4,157,146 | 6/1979 | Svenson | 220/324 |
| 4,750,648 | 6/1988 | Krydiak | 222/484 |

FOREIGN PATENT DOCUMENTS

| | | |
|---|---|---|
| 0261996 | 3/1988 | European Pat. Off. . |
| 0323531 | 7/1989 | European Pat. Off. . |
| 2168044 | 6/1986 | United Kingdom . |

*Primary Examiner*—Robert W. Jenkins

*Attorney, Agent, or Firm*—Scully, Scott, Murphy & Presser

[57] ABSTRACT

The present invention relates to a device for closing shaker lids of tins of paint on shaker machines.

This device, of the so-called cam type, including a series of lower tabs (1) mounted so as to rotate over the lid (3), the said tabs being uniformly arranged at its periphery and each actuated at the upper level by a maneuvring lever (9) in order to be applied, during service, under the opening rim (11) of the treated tin (13), by means of a spindle (5) connecting the tab (1) to the maneuvring lever (9) and mounted with freedom to slide and rotate on a suitable bearing (7) formed on the body of the lid, is characterized in that an elastic flexible tube (15) or lining is mounted with a small amount of play about the spindle (5) of each of the tabs (1), this tube being interposed between the maneuvring lever (9) and the upper end of the bearing (7).

7 Claims, 4 Drawing Sheets

DEVICE FOR CLOSING SHAKER LIDS OF TINS OF PAINT ON SHAKER MACHINES

Figure 1:
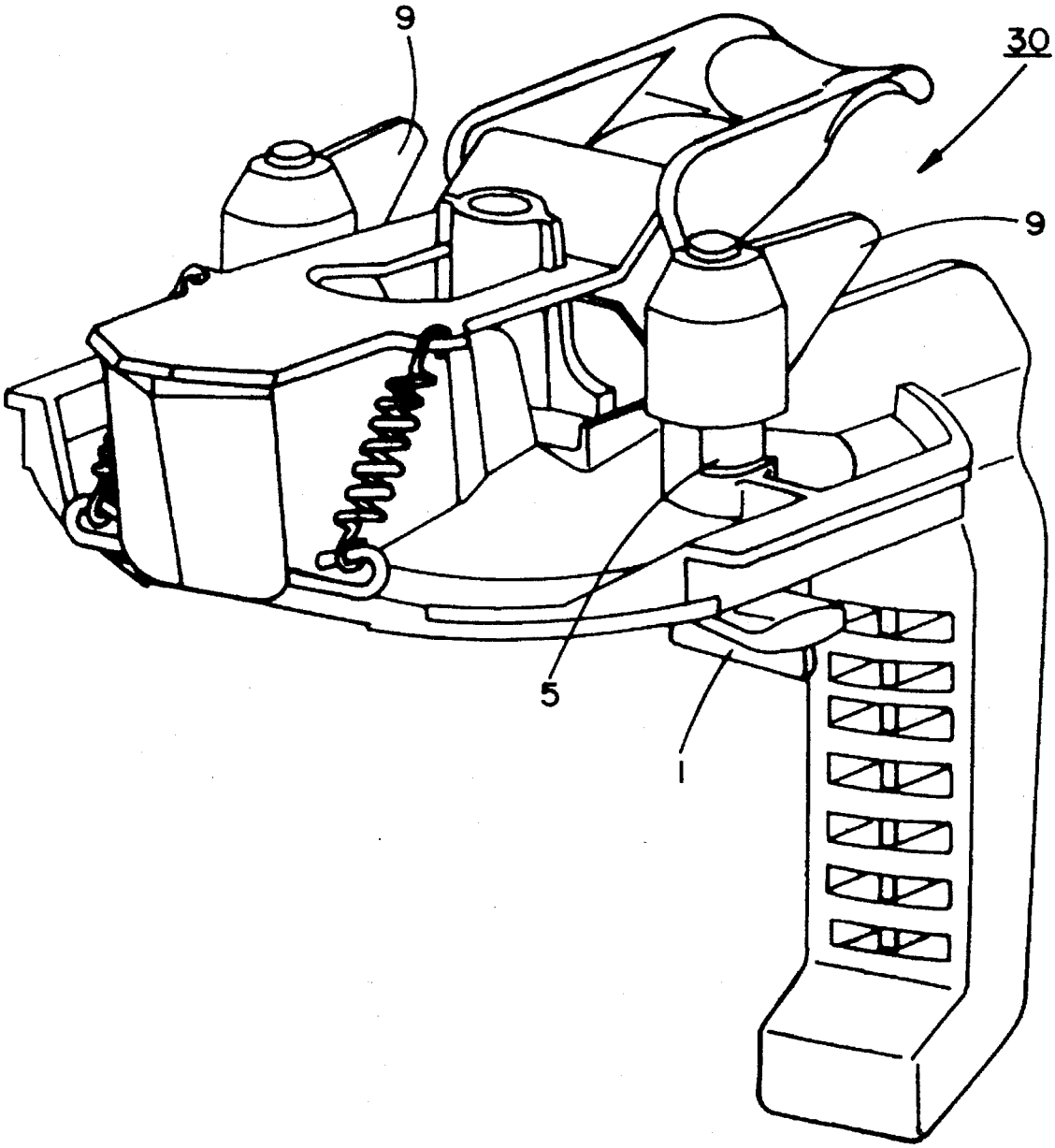

The present invention relates to a device for closing shaker lids of tins of paint on shaker machines and, in particular, to a closure device of the so-called cam type, mounted on the lid at its periphery and coming into engagement on closure over the edge of the relevant tin of paint.

These devices are known. They consist essentially of a series of tabs mounted so as to rotate over the lid, said tabs being uniformly arranged at its periphery and each actuated at the upper level by a maneuvring lever. On closure, each of the tabs is applied under the opening rim of the tin, while the maneuvring lever is turned. The tabs are pressed over the said tin rim on closure by means of an arrangement of a helical spring and a leaktight washer which are mounted about the tab spindle. The maneuvring lever is applied in rotation on a cam path formed on the lid, which raises the tab during maneuvring. Pressure compensation, at an application pressure level required for the lid on the tin, is provided by the said spring which is interposed between the maneuvring lever and the relevant mounting bearing of the tab on the lid. This spring presses on the leaktight washer applied about the said tab spindle and on a suitable base of the bearing. All the springs of the elements of the device at the periphery of the lid are calibrated identically so as to provide a uniform application pressure for closing the lid over the relevant opening of the tin. Nevertheless, these devices have a limit in terms of pressure compensation corresponding to the maximum compression of the springs when their turns come into abutment with one another. The maneuvring of these devices beyond this limit, for example for application to deep tin rims, may lead to local deformation of the latter under an excessive tab force.

The invention aims to remedy this drawback by proposing a device for closing a shaker lid of tins of paint on paint shaker machines, of the so-called cam type, including a series of lower tabs mounted so as to rotate over the lid, the said tabs being uniformly arranged at its periphery and each actuated at the upper level by a maneuvring lever in order to be applied, during service, under the opening rim of the treated tin, by means of a spindle connecting the tab to the maneuvring lever and mounted with freedom to slide and rotate on a suitable bearing formed on the body of the lid, characterized in that an elastic flexible tube or lining is mounted with a small amount of play about the spindle of each of the tabs, this tube being interposed between the maneuvring lever and the upper end of the bearing. This tube, made essentially from a rubberlike material, particularly elastomer, has a longitudinal elasticity which, by means of compression between the maneuvring lever and the upper end of the bearing, provides application compensation during pressure of the tab over the rim of the tin during closure by means of maneuvring the rotary lever.

The said tube is, moreover, applied at its lower part on a complementary base formed at the upper end of the bearing so that, when it is compressed during service, it is applied in a leaktight manner on the said bearing. In addition, the said longitudinal compression of the tube gives rise to an annular narrowing of the tube at its ends, by means of the bead effect created, and thus a tight and leaktight application during service of the tube on the spindle. Consequently, this arrangement provides pressure compensation for applying the tabs of the device during service, without the abovementioned limitation effect of conventional helical springs (abutting turns), as well as a leaktight effect over the tab spindle without the conventional leaktight washers used with the abovementioned springs.

A saving in construction of the device (material and labor) is thus obtained by virtue of the invention.

The invention also relates to a shaker lid for a tin of paint equipped with such a closure device.

Figure 2:
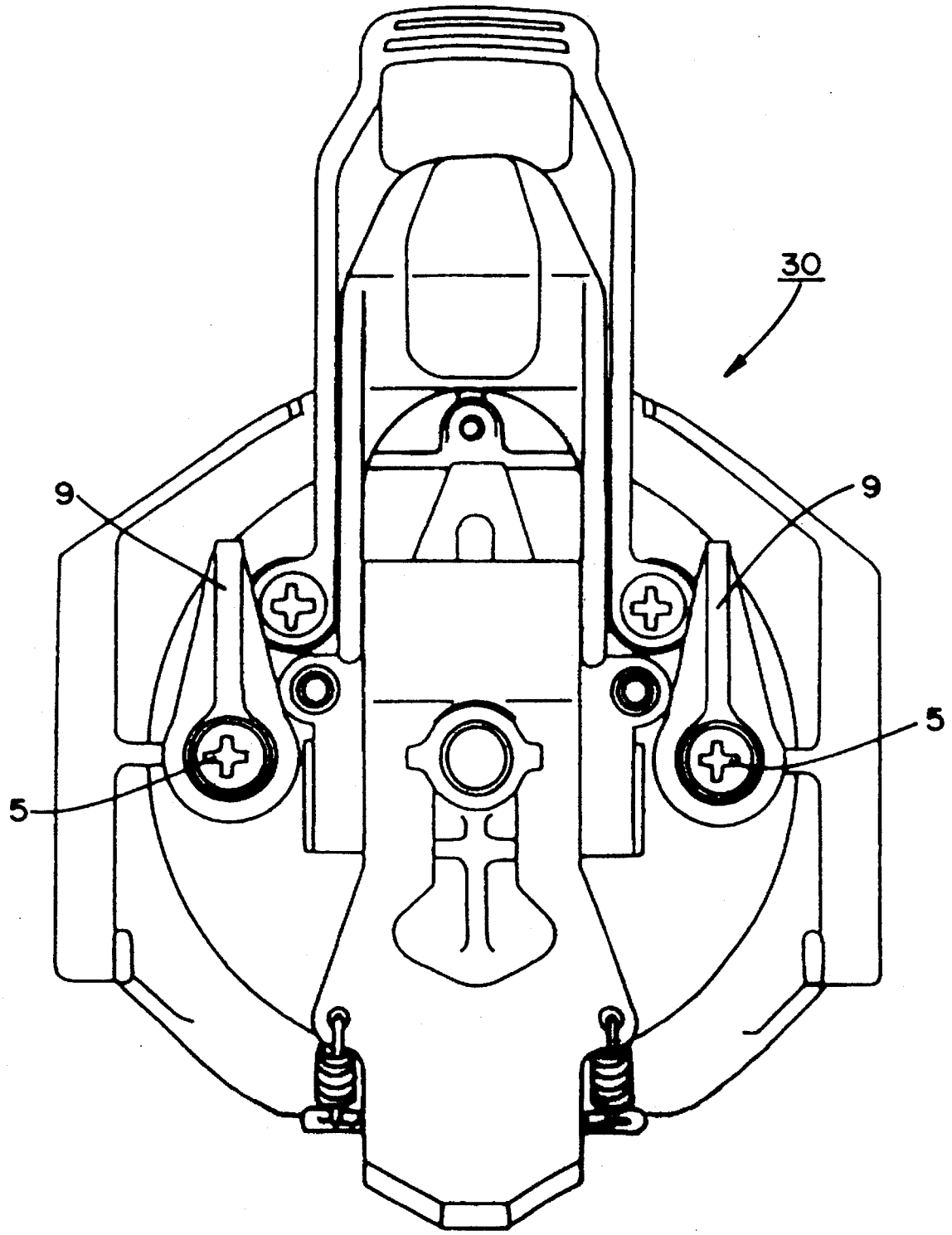
Figure 3:
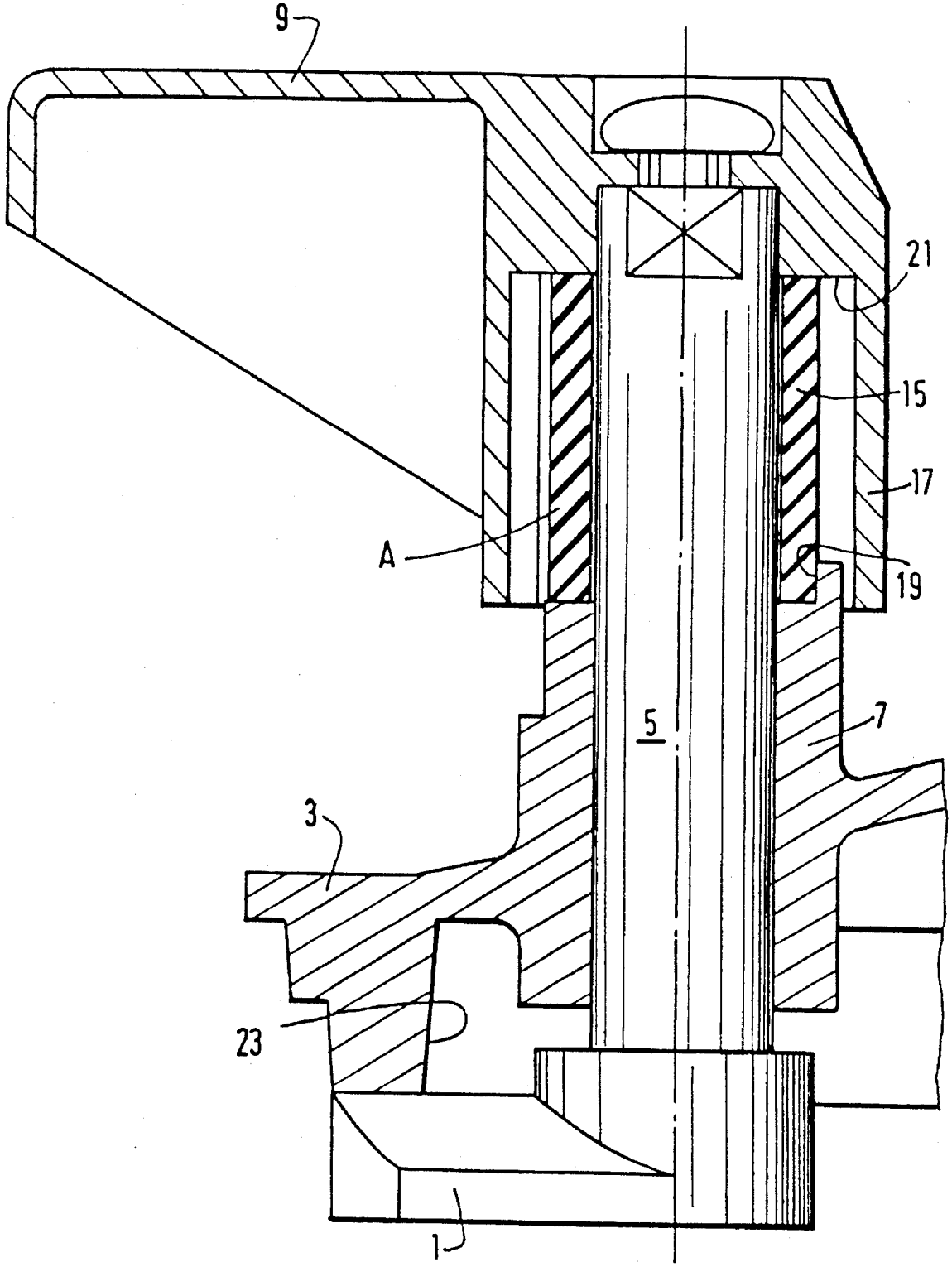
Figure 4:
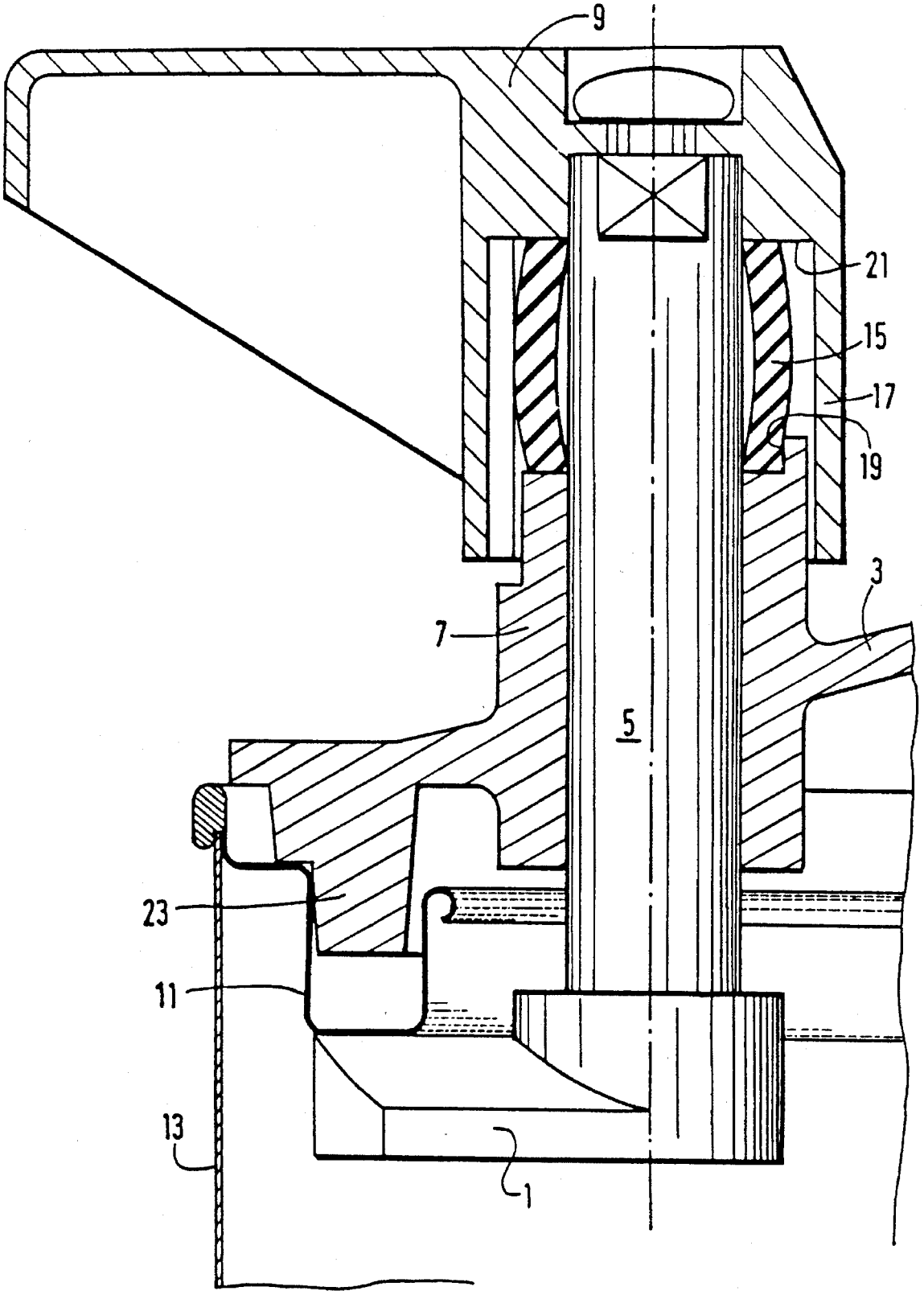

An illustrative embodiment of the invention is now described with reference to the appended drawings, in which:

FIG. 1 is a perspective view of a shaker lid incorporating the device for closing the lid pursuant to the invention, FIG. 2 is a top plan view of the shaker lid of FIG. 1, FIG. 3 is a sectional view of one of the elements or cam of the device for closing a shaker lid according to the invention, in the out-of-service position, and FIG. 4 is a view similar to the preceding one, in the service position over the rim of a tin of paint.

As shown in FIGS. 2 and 3 of the drawings, a shaker lid 30 for a tin or a can 13 for paint possesses two closure elements, as described hereinbelow in more specific detail.

In FIGS. 3 and 4 of the drawings, only one of the closure elements or cams of the device according to the invention has been shown, the said device comprising at least two to several such elements uniformly distributed over the periphery of the shaker lid, depending on the size of the lid, and all identical with one another so as to impart a uniform application pressure upon closure of the lid on the relevant tin of paint.

Each of the elements of the device consists of a lower tab 1 mounted so as to rotate over the shaker lid 3 by means of a cylindrical spindle 5 received in a vertical bearing 7, formed on the lid, and connected to an upper maneuvring lever 9. This maneuvring lever arranged above the lid makes it possible to actuate, in rotation, the lower tab which, upon closure, comes into engagement (FIG. 2) under the annular closure rim 11 of the tin 13. An elastic flexible tube 15 or lining is mounted about the spindle 5 between the rotary lever 9 and the upper end of the bearing 7. This tube is enclosed with lateral spacing in a cylindrical skirt 17 formed in the body of the lever. Via its lower end, it presses on a complementary base 19 formed at the upper end of the bearing and, via its top end, it is applied with simple contact against the bottom 21 of the inner skirt of the body of the lever.

It is made from flexible rubber and its length is determined so that, in the rest position (FIG. 1), the tab 1 is arranged substantially at the level of the edge 23 of the lid and so that, during rotation, on application, during closure, of the lid on the tin, it can be compressed in order to apply the tab 1 at the level of the tin rim 11, namely at a position which is lower by one to a few millimeters relative to its rest position to which it naturally returns without stressing. The compression of all the flexible tubes of the closure elements with their tab engaged under the tin rim exerts a uniform peripheral application pressure for closure of the lid on the tin.

Being mounted with a small amount, a few tenths of a millimeter, of play on the spindle, compression of the tube on closure tightens its lower part as well as its upper part in an annular manner about the spindle through the bead effect created, while it distances its central part so that, during service, a leaktight effect is created about the spindle at these two levels of the tube. Additionally, compression of the tube on the base of the bearing contributes to forming a leaktight effect between the bearing and the tube, so that an effect of complete leaktightness is created between the bearing and the spindle, by means of the tube, without the need for a complementary leaktight element.

I claim:

1. Device for closing a shaker lid of tins of paint on paint shaker machines of the cam type, including a plurality of lower tabs (1) mounted so as to rotate over the lid (3), said tabs being uniformly arranged at the periphery of the lid and each actuated at the upper level by a maneuvering lever (9) in order to be applied, during service, under the opening rim (11) of the applicable tin (13) by a spindle (5) connecting the tab (1) to the maneuvering lever (9) and mounted with freedom to slide and rotate on a suitable bearing (7) formed on the body of the lid, and an elastic flexible tube (15) or lining being mounted with a small amount of play about the spindle (5) of each of the tabs (1), said tube being interposed between the maneuvering lever (9) and the upper end of the bearing (7).

2. Closure device according to claim 1, characterized in that said tube (15) is made from an elastomeric material and has a longitudinal elasticity which, responsive to compression between the maneuvering lever and the upper end of the bearing, provides application compensation during pressure of the tab over the rim of the tin during closure through rotational maneuvering of the lever.

3. Closure device according to one of claims 1 or 2, characterized in that said tube (15) is applied at a lower part thereof on a complementary base (19) formed at an upper end of the bearing (7) so that, when compressed during service, said tube is applied in a leaktight manner on said bearing.

4. Closure device according to claim 1, characterized in that said tube (15) is mounted with a play of from one to a few tenths of a millimeter about the spindle (5) of the tab (1).

5. Closure device according to claim 1, characterized in that said tube (15) is enclosed with lateral spacing in a cylindrical skirt (17) formed in the body of the lever (9).

6. Closure device according to claim 5, characterized in that said tube (15) is applied the top end thereof in contact against the bottom (21) of the skirt (17) of the layer (9).

7. Closure device according to claim 1, characterized in that the length of the tube (15) is determined so that, in the rest position, the tab (1) is arranged substantially at the level of the edge (23) of the lid and so that, during rotation of the lever (9), on application, during closure, of the lid on the tin, it can be compressed in order to apply the tab (1) at the level of the tin rim (11), at a position which is lower by one to a few millimeters relative to the rest position.

* * * * *